US005954337A

United States Patent [19]

Cunningham

[11] Patent Number: 5,954,337

[45] Date of Patent: Sep. 21, 1999

[54] TOSSING GAME SYSTEM

[76] Inventor: Wanda Cunningham, 3901 S. Culgary, Tuscon, Ariz. 85735

[21] Appl. No.: 09/084,858

[22] Filed: May 26, 1998

[51] Int. Cl.[6] ..... A63B 67/06

[52] U.S. Cl. ..... 273/338; 273/401; 273/402

[58] Field of Search ..... 273/336, 337, 273/338, 339, 398, 400, 401, 402; 473/476

[56] References Cited

U.S. PATENT DOCUMENTS

| | | | |
|---|---|---|---|
| 469,554 | 2/1892 | Favor | 273/401 |
| 1,211,379 | 1/1917 | Maisch | 273/400 X |
| 1,695,937 | 12/1928 | Welch | 273/400 X |
| 1,933,159 | 10/1933 | Butler | 273/400 |
| 2,365,513 | 12/1944 | Bartle et al. | 273/339 |
| 3,586,330 | 6/1971 | Lema | 273/339 |
| 4,132,410 | 1/1979 | Montagna | 273/339 |
| 5,037,095 | 8/1991 | Nedwick | 273/400 X |
| 5,040,801 | 8/1991 | Weymuth | 273/338 |
| 5,692,979 | 12/1997 | Jones | 273/400 X |

*Primary Examiner*—William H. Grieb

*Attorney, Agent, or Firm*—Joseph N. Breaux

[57] ABSTRACT

A tossing game system that includes a target support structure including a base assembly having four detachable stabilizing legs and a vertical support having three horizontally oriented standoffs; first, second and third L-shaped ring toss targets each securable to the end of one of the three horizontally oriented standoffs; four securing stakes each insertable through a stake aperture formed through the end of each of the four detachable stabilizing legs; at least one tossing ring having a central opening of sufficient size to allow passage therethrough of the target end of each of the first, second and third L-shaped ring toss targets; first, second and third ball targets that are each securable to the end of one of the three horizontally oriented standoffs, each first, second and third ball target including a connecting structure having a ball target connecting end that is connectable to one of the three horizontally oriented standoffs, a net support ring attached to the connecting structure, and an open bottom net extending around the circumference of the net support ring; and at least one tossing ball sized to pass through each of the net support rings of the first, second and third ball targets.

12 Claims, 2 Drawing Sheets

TOSSING GAME SYSTEM

TECHNICAL FIELD

The present invention relates to amusement devices and more particularly to a tossing game system that includes a target support structure including a base assembly having four detachable stabilizing legs and a vertical support having three horizontally oriented standoffs; first, second and third L-shaped ring toss targets each securable to the end of one of the three horizontally oriented standoffs; four securing stakes each insertable through a stake aperture formed through the end of each of the four detachable stabilizing legs; at least one tossing ring having a central opening of sufficient size to allow passage therethrough of the target end of each of the first, second and third L-shaped ring toss targets; first, second and third ball targets that are each securable to the end of one of the three horizontally oriented standoffs, each first, second and third ball target including a connecting structure having a ball target connecting end that is connectable to one of the three horizontally oriented standoffs, a net support ring attached to the connecting structure, and an open bottom net extending around the circumference of the net support ring; and at least one tossing ball sized to pass through each of the net support rings of the first, second and third ball targets.

BACKGROUND OF INVENTION

It is often desirable to have some sort of amusement device on hand to provide an amusing diversion when a group of people gathers. Because some individuals will enjoy participating in one diversionary activity more than another, it is often desirable to have more than one diversionary activity to offer to a group of people. It would be a benefit, therefore, to have a tossing game system that could be configured to allow the playing of more than one diversionary game. Because it is often desirable to provide more than one target for a tossing game, it would be further desirable to provide a tossing game system that included a vertical support that included a number of horizontally oriented target supports. In an effort to provide tossing games having targets of different degrees of difficulty, it would be a further benefit to have a tossing game system that included a vertical support that included a number of graduated length horizontally oriented target supports for supporting targets at different distances from a player. It would be a still further benefit to have more that one type of tossing element, such as a ball and a ring, and more than one type of target, such as a hoop and an upright, that could be selected for use by the players.

SUMMARY OF INVENTION

It is thus an object of the invention to provide a tossing game system that is configurable to allow the playing of more than one diversionary game.

It is a further object of the invention to provide a tossing game system that includes a vertical support having a number of horizontally oriented target supports.

It is a still further object of the invention to provide a tossing game system that includes a vertical support having a number of graduated length horizontally oriented target supports for supporting targets at different distances from a player.

It is a still further object of the invention to provide a tossing game system that includes more that one type of tossing element, such as a ball and a ring.

It is a still further object of the invention to provide a tossing game system that includes more than one type of target, such as a hoop and an upright.

It is a still further object of the invention to provide a tossing game system that includes a target support structure including a base assembly having four detachable stabilizing legs and a vertical support having three horizontally oriented standoffs; first, second and third L-shaped ring toss targets each securable to the end of one of the three horizontally oriented standoffs; four securing stakes each insertable through a stake aperture formed through the end of each of the four detachable stabilizing legs; at least one tossing rings having a central opening of sufficient size to allow passage therethrough of the target end of each of the first, second and third L-shaped ring toss targets; first, second and third ball targets that are each securable to the end of one of the three horizontally oriented standoffs, each first, second and third ball target including a connecting structure having a ball target connecting end that is connectable to one of the three horizontally oriented standoffs, a net support ring attached to the connecting structure, and an open bottom net extending around the circumference of the net support ring; and at least one tossing ball sized to pass through each of the net support rings of the first, second and third ball targets.

It is a still further object of the invention to provide a tossing game system that accomplishes all or some of the above objects in combination.

Accordingly, a tossing game system is provided that includes a target support structure including a base assembly having four detachable stabilizing legs and a vertical support having three horizontally oriented standoffs; first, second and third L-shaped ring toss targets each securable to the end of one of the three horizontally oriented standoffs; four securing stakes each insertable through a stake aperture formed through the end of each of the four detachable stabilizing legs; at least one tossing rings having a central opening of sufficient size to allow passage therethrough of the target end of each of the first, second and third L-shaped ring toss targets; first, second and third ball targets that are each securable to the end of one of the three horizontally oriented standoffs, each first, second and third ball target including a connecting structure having a ball target connecting end that is connectable to one of the three horizontally oriented standoffs, a net support ring attached to the connecting structure, and an open bottom net extending around the circumference of the net support ring; and at least one tossing ball sized to pass through each of the net support rings of the first, second and third ball targets.

The diameters of each of the net support rings of the first, second and third ball targets are preferably of increasing size. The net support rings of each of the first, second and third ball targets are preferably positionable at user selected angles. The tossing ball is preferably constructed with a flexible fabric or plastic outer shell that is stuffed with fibers to prevent injury to the players. It is also preferred to place a small mass, such as a lead weight, into the center of the fiber filled tossing ball to provide greater tossing performance.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY EMBODIMENTS

Figure 1:
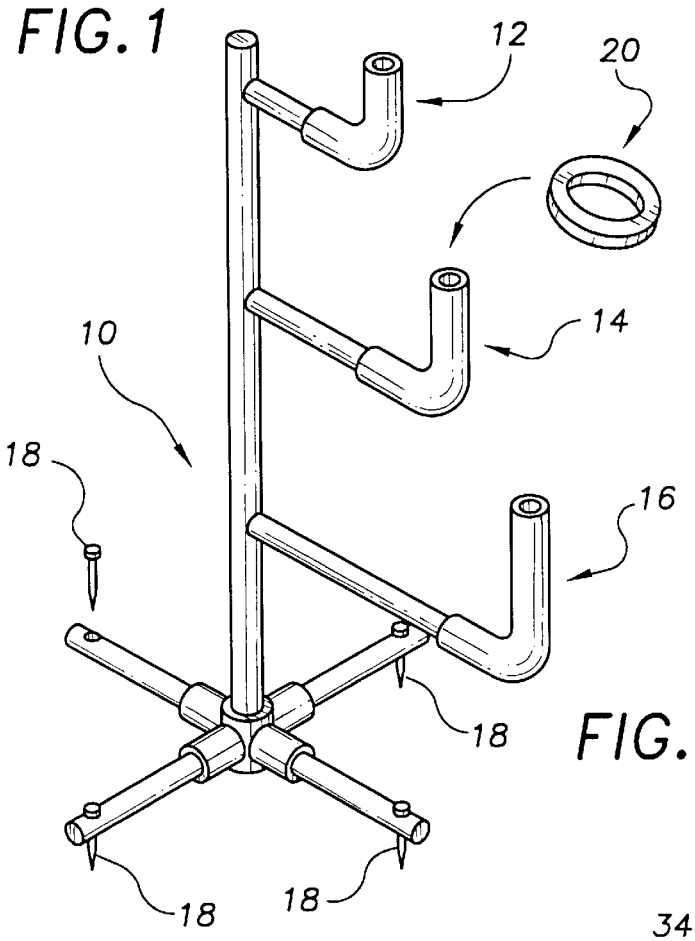
FIG. 1 is a perspective view of an exemplary embodiment of the tossing game system of the present invention showing the target support structure including the base assembly and the vertical support; the first, second and third L-shaped ring toss targets each secured to the end of one of the three horizontally oriented standoffs extending from the vertical support; the four securing stakes each insertable through the stake aperture formed through the end of each of the four detachable stabilizing logs; and one of the foam plastic tossing rings.

An exemplary embodiment of the tossing game system of the present invention is now described with reference to FIGS. 1–5. With reference to FIG. 1, in this embodiment, the tossing game system of the present invention includes a target support structure, generally designated 10; first, second and third ball targets, generally designated 12,14,16 respectively; four securing stakes 18; a number of foam plastic tossing rings, generally designated 20; first, second and third L-shaped ring toss targets, generally designated 22,24,26, respectively (FIG. 4); and a number of cloth shelled, fiber filled tossing balls, generally designated 28 (FIG. 5).

Figure 2:
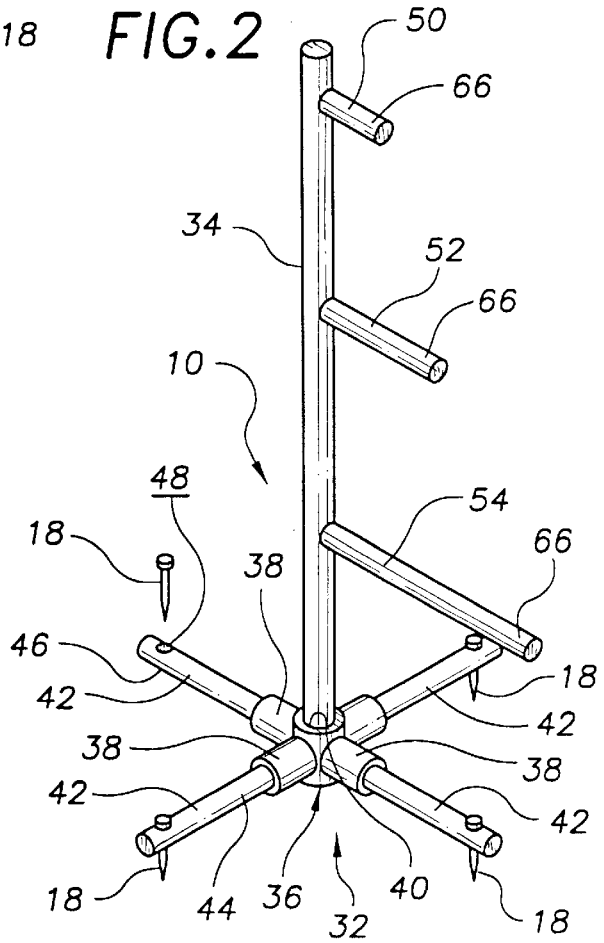
FIG. 2 is a perspective view of the exemplary target support structure showing the central base hub; the connecting leg ends of the four identical detachable stabilizing legs inserted into the stabilizing leg fittings of the central base hub; the connecting vertical support end of the detachable vertical support inserted into the vertical support fitting of the central base hub; the three horizontal standoffs extending perpendicularly from the vertical support; and the four securing stakes.

With reference to FIG. 2, in this embodiment, target support structure 10 includes a base assembly, generally designated 32, and a vertical support 34. Base assembly 32 includes a molded plastic, central base hub, generally designated 36, having four spaced, cylindrically shaped stabilizing leg fittings 38 and a vertical support fitting 40; and four identical detachable stabilizing legs 42. Each of the four identical detachable stabilizing legs 42 has a connecting leg end 44 that is friction fit into one of the four cylindrically shaped stabilizing leg fittings 38 and a free end 46 that has a stake passageway 48 formed therethrough. Stake passageways 48 are provided to allow stakes 18 to be used to secure the four identical detachable stabilizing legs 42 to the ground for added stability.

Vertical support 34 is an elongated length of molded plastic having integrally molded plastic first, second, and third horizontal standoffs 50,52,54, respectively, extending perpendicularly from the elongated length of molded plastic. In this embodiment, first horizontal standoff 50 is six inches (6") in length, second horizontal standoff 52 is twelve inches (12") in length, and third horizontal standoff 54 is eighteen inches (18") in length. First horizontal standoff 50 is positioned above second horizontal standoff 52. Second horizontal standoff 52 is positioned above third horizontal standoff 54.

Figure 3:
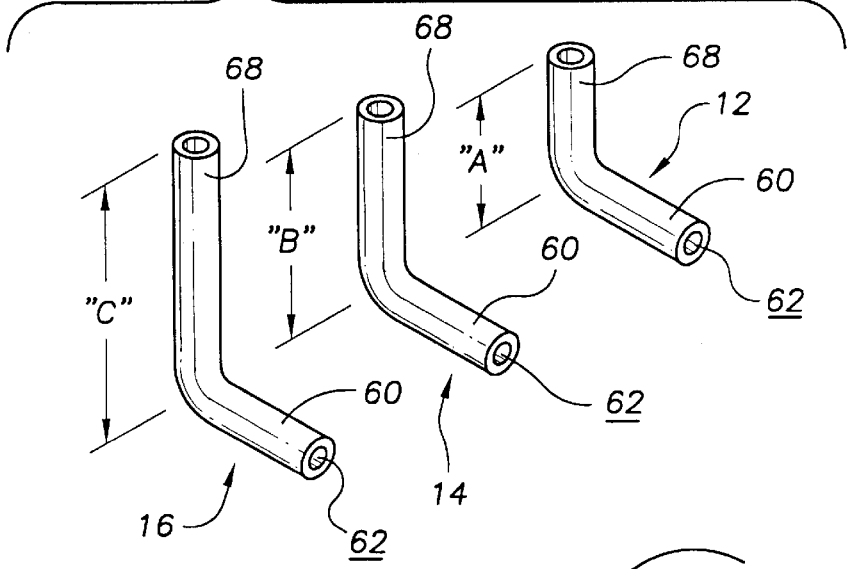
FIG. 3 is a perspective view of the first, second and third L-shaped ring toss targets in isolation, each first, second and third L-shaped ring toss target having a target connecting end and a target end.

With reference now to FIG. 3, first, second and third L-shaped ring toss targets 12,14,16 each include a target connecting end 60 that is provided with a cylinder shaped fitting cavity 62 sized to frictionally receive a free end 66 (FIG. 2) of each of the first, second, and third horizontal standoffs 50,52,54 (FIG. 2). First L-shaped ring toss target 12 has a target end 68 having a length "A" of three inches (3"). Second L-shaped ring toss target 14 has a target end 68 having a length "B" of five inches (5"). Third L-shaped ring toss target 16 has a target end 68 having a length "c" of seven inches.

Figure 4:
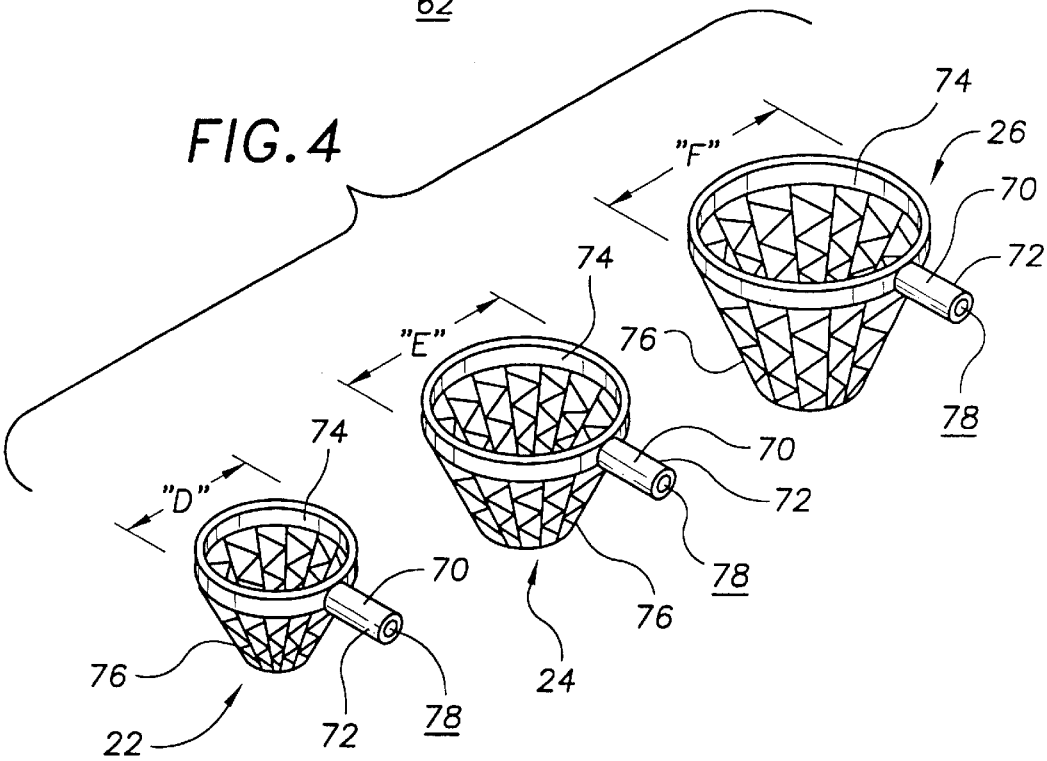
FIG. 4 is a perspective view of the three exemplary ball targets that are provided in this exemplary embodiment of the tossing game system of the present invention; each ball target including a connecting structure including ball target connecting end, a net support ring attached to the connecting structure, and an open bottom net extending around the circumference of the net support ring.
Figure 5:
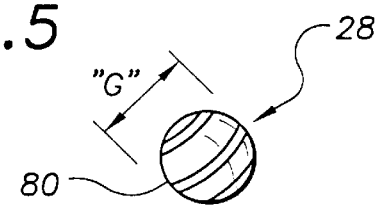
FIG. 5 is a perspective view an exemplary embodiment of the fiber filled tossing ball of the exemplary tossing game system of the present invention that is used in conjunction with the three ball targets of FIG. 4.

With reference to FIG. 4, first, second, and third ball targets 22,24,26 each include a connecting structure 70 having a ball target connecting end 72, a net support ring 74, and an open bottom nylon net 76. Each ball target connecting end 72 has a cylinder shaped fitting cavity 78 sized to frictionally receive a free end 66 (FIG. 2) of each of the first, second, and third horizontal standoffs 50,52,54 (FIG. 2). The net support ring 74 of first ball target 22 has a diameter "D" of ten inches (10"). The net support ring 74 of second ball target 24 has a diameter "E" of fourteen inches (14"). The net support ring 74 of third bail target 26 has a diameter "F" of eighteen inches (18").

With reference to FIG. 5, fiber filled tossing ball 28 has a spherically shaped, nylon fabric shell 80 that is stuffed with nylon fiber fill and has a steel ball (not shown) secured within the center of the fiber fill. Spherical fabric shell 80 has a diameter "G" of four inches (4").

It can be seen from the preceding description that a tossing game system has been provided that is configurable to allow the playing of more than one diversionary game; that includes a vertical support having a number of horizontally oriented target supports; that includes a vertical support having a number of graduated length horizontally oriented target supports for supporting targets at different distances from a player; that includes more that one type of tossing element, such as a ball and a ring; that includes more than one type of target, such as a hoop and an upright; and that includes a target support structure including a base assembly having four detachable stabilizing legs and a vertical support having three horizontally oriented standoffs; first, second and third L-shaped ring toss targets each securable to the end of one of the three horizontally oriented standoffs; four securing stakes each insertable through a stake aperture formed through the end of each of the four detachable stabilizing legs; at least one tossing rings having a central opening of sufficient size to allow passage therethrough of the target end of each of the first, second and third L-shaped ring toss targets; first, second and third ball targets that are each securable to the end of one of the three horizontally oriented standoffs, each first, second and third ball target including a connecting structure having a ball target connecting end that is connectable to one of the three horizontally oriented standoffs, a net support ring attached to the connecting structure, and an open bottom net extending around the circumference of the net support ring; and at least one tossing ball sized to pass through each of the net support rings of the first, second and third ball targets.

It is noted that the embodiment of the tossing game system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A tossing game system comprising:

a target support structure including a base assembly having four detachable stabilizing legs and a vertical support having three horizontally oriented standoffs;

first, second and third L-shaped ring toss targets, each securable to said end of one of said three horizontally oriented standoffs;

four securing stakes each insertable through a stake aperture formed through said end of each of said four detachable stabilizing legs;

at least one toss ring having a central opening of sufficient size to allow passage therethrough of a target end of each of said first, second and third L-shaped ring toss targets;

first, second and third ball targets that are each securable to an end of one of said three horizontally oriented standoffs, each first, second and third ball target including a connecting structure having a ball target connecting end that is connectable to one of said three horizontally oriented standoffs, a net support ring attached to said connecting structure, and an open bottom net extending around said circumference of said net support ring; and at least one tossing ball sized to pass through each of said net support rings of said first, second and third ball targets.

2. The tossing game system of claim 1, wherein:

each of set net support rings of said first, second and third ball targets having a different diameter.

3. The tossing game system of claim 1, wherein:

said net support rings of said first, second and third ball targets include angle adjustment means for adjusting each said net support ring to a user selected angle.

4. The tossing game system of claim 1 wherein:

said tossing ball has a flexible outer shell that is stuffed with fibers.

5. The tossing game system of claim 4 wherein:

said tossing ball includes a small mass positioned within said center of said fibers positioned within said flexible outer shell.

6. The tossing game system of claim 2, wherein:

said net support rings of said first, second and third bail targets include angle adjustment means for adjusting each said net support ring to a user selected angle.

7. The tossing game system of claim 2 wherein:

said tossing ball has a flexible outer shell that is stuffed with fibers.

8. The tossing game system of claim 7 wherein:

said tossing ball includes a small mass positioned within said center of said fibers positioned within said flexible outer shell.

9. The tossing game system of claim 6 wherein:

said tossing ball has a flexible outer shell that is stuffed with fibers.

10. The tossing game system of claim 9 wherein:

said tossing ball includes a small mass positioned within said center of said fibers positioned within said flexible outer shell.

11. The tossing game system of claim 3 wherein:

said tossing ball has a flexible outer shell that is stuffed with fibers.

12. The tossing game system of claim 11 wherein:

said tossing ball includes a small mass positioned within said center of said fibers positioned within said flexible outer shell.

* * * * *